US006884397B2

(12) United States Patent
Day

(10) Patent No.: US 6,884,397 B2
(45) Date of Patent: Apr. 26, 2005

(54) SAMPLE TUBES WITH FLUID-TIGHT LABELS

(75) Inventor: Paul Francis Day, Chipstead (GB)

(73) Assignee: Advanced Biotechnologies Limited (GB)

( * ) Notice: Subject to any disclaimer, the term of this patent is extended or adjusted under 35 U.S.C. 154(b) by 419 days.

(21) Appl. No.: 09/995,871

(22) Filed: Nov. 29, 2001

(65) Prior Publication Data

US 2002/0098126 A1 Jul. 25, 2002

(30) Foreign Application Priority Data

Nov. 29, 2000 (GB) ..... 0029085

(51) Int. Cl.[7] ..... B01N 3/14

(52) U.S. Cl. ..... 422/102; 422/104; 436/56; 210/85; 210/94; 235/375; 494/10

(58) Field of Search ..... 422/99, 102, 104; 436/56; 210/94, 85; 235/375; 73/301, 149; 494/10, 16, 19

(56) References Cited

U.S. PATENT DOCUMENTS

| | | | | |
|---|---|---|---|---|
| 3,818,188 A | | 6/1974 | Hertel et al. | |
| 5,019,243 A | | 5/1991 | McEwen et al. | 210/94 |
| 5,405,510 A | * | 4/1995 | Betts et al. | 205/782 |
| 5,777,303 A | | 7/1998 | Berney | |
| 5,871,700 A | | 2/1999 | Konrad | 422/102 |
| 5,894,733 A | | 4/1999 | Brodner | 62/51.1 |
| 6,138,915 A | | 10/2000 | Danielson et al. | |

FOREIGN PATENT DOCUMENTS

| | | | |
|---|---|---|---|
| EP | 0 706 825 A1 | 4/1996 | B01L/3/14 |
| EP | 0875292 | 11/1998 | |
| WO | WO 89/08264 | 9/1989 | |
| WO | WO 96/08433 | 3/1996 | |
| WO | WO 99/03585 | 1/1999 | |

* cited by examiner

*Primary Examiner*—Lyle A. Alexander
(74) *Attorney, Agent, or Firm*—Wood, Herron & Evans, L.L.P.

(57) ABSTRACT

A sample tube assembly incorporating a fluid-tight label chamber, said label chamber being fused to or forming part of the body of the sample tube. The invention also includes a sample tube assembly wherein the tube assembly comprises; a tube portion, the bottom of which is adapted to accept an end cap; and end cap adapted to be joined to the bottom of the tube portion; and a label chamber provided in use by a space between the bottom or outer surface of the bottom of the tube portion and the inner surface of the end cap; and wherein the end cap is fused, welded or otherwise joined to the bottom of the tube portion to provide a fluid tight-seal.

38 Claims, 7 Drawing Sheets

SAMPLE TUBES WITH FLUID-TIGHT LABELS

FIELD OF THE INVENTION

The present invention relates to tubes bearing a unique identifying label. It is particularly applicable, but in no way limited, to labelling storage tubes such as cluster tubes.

BACKGROUND OF THE INVENTION

In science laboratories there is a growing need to operate on and store increasingly large numbers of samples. These samples need to be retrieved quickly and unambiguously as and when required. Furthermore, an increasing number of laboratories are moving to robotic handling of samples.

A typical example of this type of problem is when samples are kept in so-called cluster tubes stored in a cluster plate. Ideal for sample storage, a 1.2 ml micro-tube cluster plate comprises 96 individual 1.2 ml tubes held in place by a heavy duty rack in a standard microplate format. Made from polypropylene, each tube is fully supported at the base or around a collar to withstand the pressure applied by robotic systems. Caps or mats are provided to seal each tube individually and the lid of the cluster plate has bevelled comers for a "one way" fit. Packs of loose tubes are available in order that the rack system can be re-used. The individual positions within a plate are designated in the typical 96 well formal using letters A to H and numbers 1 to 12. Thus position F9 indicates a specific tube within the array. However, identification of a specific tube is more complicated when there are many tens of thousands of micro tube cluster plates held in the same storage area.

The concept of uniquely labelling each tube is known. For example, the outside of the tube on the bottom can have a two layer coating applied to it. A code can then be etched into the top or outermost layer of the coating by a laser etching process or the like. Such technology has been used by Matrix.

This process has a number of inherent disadvantages. Firstly, the etchable coating must be applied to the bottom of the tube. These tubes are typically used with a wide range of organic solvents including DMSO. It follows that, in the event of a spillage, the two layer coating must be both secure and completely inert to all solvents. This is not easy to achieve and, where it has been achieved, inevitably increases the cost significantly.

Secondly, if the top coating becomes scratched slightly during manipulation of the tube, then this could alter or degrade the unique code by accident. This could have very serious implications for an experiment and many man hours and expensive reagents could be lost in repeat experiments. Where the original sample was unique, it could be that the experiment can never be repeated.

All of the above adds to the cost of the finished product.

In a further known example of coding a tube, a slug of non-transparent rubber or plastics material is embedded into the base of the tube. This is then coded by laser etching directly, usually with a series of pits in the form of a binary code. Once again, if a spurious scratch or pit finds its way onto the bottom of the tube the unique code is lost. In addition, the process for embedding or attaching a slug or layer of opaque material on the bottom of a small tube is not necessarily straightforward and adds significantly to the cost of the tube even before adding the cost of laser etching.

It is also known to attach an electronic code carrier to the base of a tube. Examples of this type of technology are described in WO89/08264 (Ballies) and WO99/03585 (Clids OY). In both these examples the memory device is detachable. Although the memory device is encapsulated in a liquid-tight casing this is not sealed to the bottom of the tube.

Collectively, this is the closed prior art know to the applicant.

It is the object of the present invention to eliminate or at least mitigate some or all of the problems outlined above.

SUMMARY OF THE INVENTION

According to the first aspect of the present invention there is provided a sample tube assembly incorporating a fluid-tight label chamber, said label chamber being attached to or forming part of the body of the sample tube. By encapsulating the label within a sealed housing a printed label can be used which has been printed using conventional printing technology. Laser etching is no longer essential, but can be used.

Preferably the tube assembly comprises:

(i) a tube portion, the bottom of which is adapted to accept an end cap; and (ii) an end cap adapted to be joined to the bottom of the tube portion; and (iii) a label chamber provided in use by a space between the bottom or outer surface of the bottom of the tube portion and the inner surface of the end cap;

and wherein the end cap is fused, welded or otherwise joined to the bottom of the tube portion to provide a fluid tight-seal. This two-part construction means that any convenient printed or etched label can be used and it is automatically protected from contact with solvents, abrasives or the like.

Preferably the end cap comprises a base and an upstanding sidewall extending substantially around the perimeter of the cap, the outermost end edge of the sidewall being adapted to cooperate with a shoulder formed around the bottom of the tube portion Preferably the end cap sidewall incorporates a ridge extending substantially around the circumference of the sidewall. This arrangement improves the quality and integrity of the seal between the end cap and the tube portion.

In one alternative embodiment, prior to assembly the shoulder on the bottom of the tube portion also incorporates a ridge extending substantially around the circumference of the tube portion.

In a particularly preferred embodiment the ridge on the end cap and the ridge on the tube portion contact each other when the end cap is placed onto the end of the tube portion.

Preferably during the assembly manufacturing process material in the two contacting ridges is heated and compressed to form a fluid tight seal between the tube portion and the end cap.

In an alternative embodiment the shoulder on the tube portion incorporates a groove or depression adapted to co-operatively engage with a corresponding ridge on the end edge of the end cap sidewall.

Alternatively, the shoulder on the tube portion incorporates a ridge adapted to co-operatively engage with a corresponding groove or channel on the end edge of the end cap sidewall.

Advantageously the said groove or depression comprises an endless groove or depression extending substantially around the circumference of the cap and/or the tube portion as appropriate.

Preferably the end cap is a snap fit with the reduced diameter end region.

In the above embodiments preferably the assembly further comprises a label.

Preferably the label is a laser etched label. Laser etching gives a very clearly defined image and is better suited to producing multiple labels where the code on each label is different.

The label may be formed from paper or from a plastics material.

The label may also be a printed label. Printing is cheap and economical and high definition printers are now available at modest cost. Because the substrate is protected from the elements a printed paper label is acceptable.

In one embodiment the label incorporates a bar code.

In an alternative embodiment the label incorporates a binary code. Many forms of binary code and bar codes are available and new coding systems are being developed over time. This invention is intended to encompass all known codes as well as those yet to be discovered.

Preferably the label incorporates an alphanumeric code together with either a bar code or a binary code.

Preferably the end cap is fused to the tube portion using ultrasound. This technique works particularly well with small tubes.

Preferably a region in the end cap over the label is substantially transparent to visible light.

According to a second aspect of the invention there is provided a sample tube assembly incorporating a label characterised in that the label is encapsulated within a sealed housing or label chamber.

Preferably the label incorporates a code consisting of optically readable characters.

Preferably the tube assembly according to the second aspect comprises:

(i) a tube portion, the bottom of which is adapted to accept an end cap; and (ii) an end cap adapted to be joined to the bottom of the tube portion; and (iii) a label chamber provided in use by a space between the bottom or outer surface of the bottom of the tube portion and the inner surface between the bottom or outer surface of the bottom of the tube portion and the inner surface of the end cap; and (iv) a label;

and wherein the end cap is fused, welded or otherwise joined to the bottom of the tube portion to provide a fluid tight-seal around the circumference of the cap.

Preferably the end cap comprises a base and an upstanding sidewall extending substantially around the perimeter of the cap, the outermost end edge of the sidewall being adapted to cooperate with a shoulder formed around the bottom of the tube portion.

Preferably prior to assembly, the end cap sidewall and the bottom of the tube portion both incorporate a ridge of material extending substantially around the circumference of the respective components.

Preferably prior to forming the sealed housing, the ridge on the end cap and the ridge on the tube portion contact each other when the end cap is placed onto the end of the tube portion.

Preferably the label incorporates a bar code or a binary code.

In a particularly preferred embodiment the label comprises a laser etched label.

Alternatively, the label comprises a printed label.

According to a third aspect of the present invention there is provided a method of constructing a sample tube assembly as described herein comprising the steps of:

(i) forming a tube portion;

(ii) forming an end cap for the closed end of the tube;

(iii) placing a label in the end cap;

(iv) placing the end cap onto the bottom of the tube portion and forming a fluid tight seal between the two components such that the label becomes encapsulated in a fluid tight chamber.

Preferably the two components are fused together using ultrasound.

According to a fourth aspect of the present invention there is provided a method of constructing a sample tube assembly as described herein comprising the steps of:

(i) encapsulating a label in a fluid tight label chamber;

(ii) attaching said label chamber to a tube.

According to a fifth aspect of the present invention there is provided a method of constructing a sample tube assembly as described herein comprising the steps of:

(i) forming a tube from an inner and an outer tube wall component, said components being adapted to nest one within another;

(ii) fusing or otherwise joining the two tube wall components to form a fluid tight label chamber therebetween.

BRIEF DESCRIPTION OF THE DRAWINGS

Embodiments of the present invention will now be more particularly described by way of example only and with reference to the accompanying drawings in which.

DESCRIPTION OF THE PREFERRED EMBODIMENTS

The present embodiments represent currently the best ways known to the applicant of putting the invention into practice. But they are not the only ways in which this could be achieved. They are illustrated, and they will now be described, by way of example only.

Figure 1:
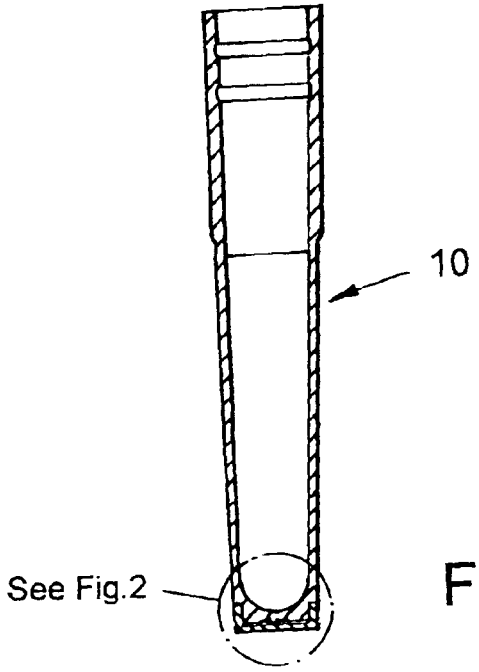
FIG. 1 illustrates a cross-sectional view of a tube according to a first embodiment of the present invention.

FIG. 1 illustrates a cluster tube 10 incorporating the present invention. The detail of the bottom of this cluster tube is shown more clearly in FIG. 2. Whilst the following description will show how the invention can be used in the context of a cluster tube, it will be appreciated that the invention can be applied to virtually any storage tube made of plastics material or glass.

Figure 2:
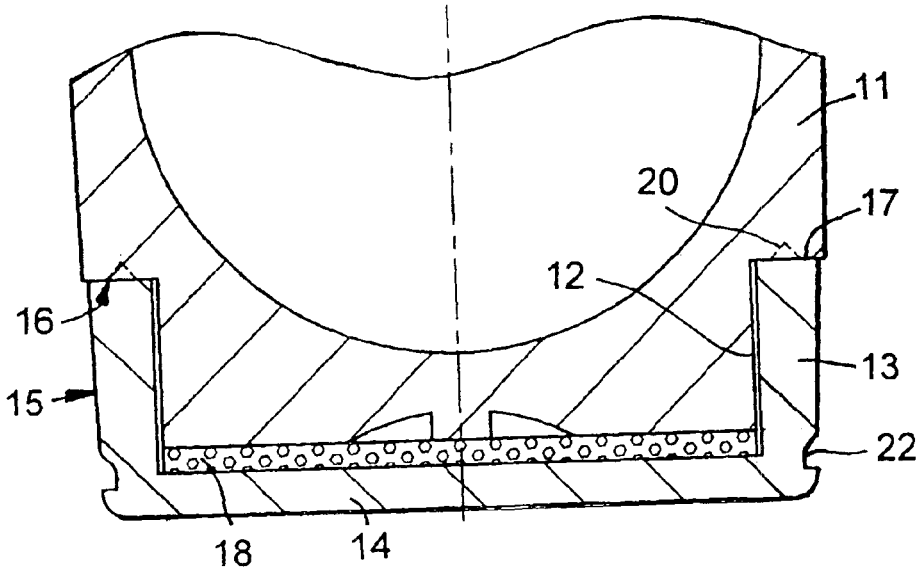
FIG. 2 illustrates an enlarged view of the bottom tip of the tube shown in FIG. 1.

FIG. 2 illustrates the bottom end of a tube portion 11 from a storage tube assembly generally shown as 10. The bottom end of the tube portion has a reduced diameter end region 12. Adapted to fit over this end region is a bottom end cap 13. Preferably the bottom end cap 13 is a snap fit over the reduced diameter end region 12. The cap 13 consists of a base or cover 14 and an upstanding sidewall 15 which extends substantially around the perimeter of the cap, with the outermost end edge of the sidewall being adapted to engage with a shoulder formed on the reduced diameter end region of the tube portion. The result is a shallow cap or cup with a cross-sectional profile of a stretched U. In use when the cap is snapped into place the outermost end edge 16 of sidewall 15 butts against a shoulder 17 at the interface between the bottom end of the tube portion and the reduced diameter end region 12. With the cap 13 firmly in place there is a space between the bottom or outer end surface of the end region 12 of the tube portion and the inside or inner surface of the cap base 14. This space, which is in effect a label chamber is adapted to accommodate a label. The cap is then sealed onto the end of the tube portion to encapsulate the label within a sealed housing which is substantially fluid tight.

This sealing can be achieved in a number of ways. If the tube portion and the end cap are made of plastic, then they can be welded together, preferably using ultrasonic welding techniques. Other forms of welding can also be used. Alternatively, an adhesive can be used. The preferred method of forming a fluid tight label chamber in the base of the tube portion will be determined by the materials specialist.

In the case of ultrasonic welding, various features can be used to improve the efficiency of an ultrasonic weld. For example, FIG. 2 illustrates a "tongue and groove" effect which can be created between the reduced diameter end region of the tube portion and the cap. For example, the shoulder region 17 can incorporate a groove 20 which corresponds in size and shape with a ridge 21 on the end edge of the cap sidewall. This latter feature is shown more clearly in FIG. 4. In effect, the ridge on the cap and the groove on the tube shoulder co-operative engage with each other. However, it must be stressed that this is an optional feature and is not essential for forming a seal between the two components.

An indentation 22 on the rim of the cap around the outer circumference aids removal and placement of the cap.

It will be appreciated that this fluid tight label chamber arrangement offers the great advantage that the label can be made from any suitable material. That material need not be chemically resistant to solvents such as DMSO since it is sealed within its own space or label chamber. This also means that the label can be printed using conventional high definition printing techniques. No laser etching is necessary, although it may be preferred to use laser etching to achieve the definition required and because each individual label carries a different code. This also means that a greater variety of codes and code types can be used. For example, the labels can be printed in many different colours either by using colour printing or by using different coloured substrates. Various types of bar codes or binary bit codes can be used and new types of codes can easily be adopted as they are developed. The label can also include alphanumerics. This offers the possibility of a cross check in case the binary or bar code becomes corrupted. Thus the same unique identifier can be printed as a bar code or as a binary code or as some other code and as an alphanumeric. The code scanning equipment is arranged to read both codes and to issue a warning if the two codes do not agree.

The person skilled in the art of high definition printing will select the most appropriate substrate to use as a label. This may be a plastics material, paper or some other composite. That person skilled in the art will also select the most suitable printing or etching process to use such as laser printing, ink jet printing or laser etching.

One of the key features of this invention is that a machine readable unique identifier code or label is sealed into a fluid tight chamber on the base of the tube. The code bearing face of the label is oriented such that the code can be read from beneath the base of the tube. Preferably the code is etched onto the label. In any event, the code takes the form of optical characters or shapes generated on one face of a label, and which can be read by machine. The exact format of the code and the method by which the code is generated is not critical to the invention.

An important aspect of the present invention is that the label incorporates optically readable characters, as opposed to an electronic code carrier. Optical character readers are well known and are becoming increasingly sophisticated. One such device is described in U.S. Pat. No. 6,138,915 (Danielson et al). However, this is just one of many types of reader which are available. By using printed or etched labels the cost and complexity of the system is kept to a minimum. By sealing the label in a special fluid tight label chamber the label is protected from damage by solvents or by physical abrasion.

For this reason the bottom end cap is preferably formed from a transparent or substantially transparent material. The bottom of the cap acts as a form of lens through which the coded label can be viewed.

Another advantage of this type of construction is that the action of placing the bottom end cap onto the bottom of the tube portion can be used to cut or shear the label from a sheet of labels. It will be appreciated that there is a form of shearing action caused by the end cap sidewall passing down the side of the reduced diameter end region of the tube portion. This shearing or punching action can be used to cut a label disc for a sheet. The label discs could be partially perforated before the label is punched out.

Assembly of the storage tube assembly then becomes a simple matter, An array of tube portions is arranged with the tubes open ends downwards, ie bottom ends up. A sheet of pre-printed labels is laid over the top of the tube array and aligned correctly with the tubes. Bottom end caps are brought over the tubes either singularly or in an array, and pressed firmly into place. Excess labelling material is removed and the end caps then sealed onto the tube portions.

In the alternative, this assembly can be done the other way round. That is to say, cups are laid in an array, base down or open side up. A sheet of labels is laid over the top of the caps and an array of tube portions, bottom end down, are brought down and forced into the caps. To facilitate handling and arranging the caps they can be formed in an array with interconnecting links. These links are only removed once the assembly stage is complete.

In an alternative method of assembly a label is placed into an end cap such that the printed or etched face of the label is visible through the bottom of the cap. The cap, plus the label retained in it, is then placed onto the bottom of a tube and the two components welded or otherwise fused together to create a fluid tight label chamber.

It is intended that this invention and this disclosure extends to include these various methods of assembly.

Whilst the tubes described thus far have been substantially circular in cross-section, it will be appreciated that any suitable cross-sectional profile of tube can be used in this invention. Thus, square, rectangular or polygonal profile tubes can have bottom end caps fitted in a similar manner.

Alternatively constructional details are shown in FIGS. 3 to 12 inclusive. These illustrate various arrangements for forming a fluid tight joint or weld between the bottom end cap and the bottom of the tube portion. In this context the term "fluid" has its broadest meaning and encompasses a liquid, a gas or a vapour.

Figure 3:
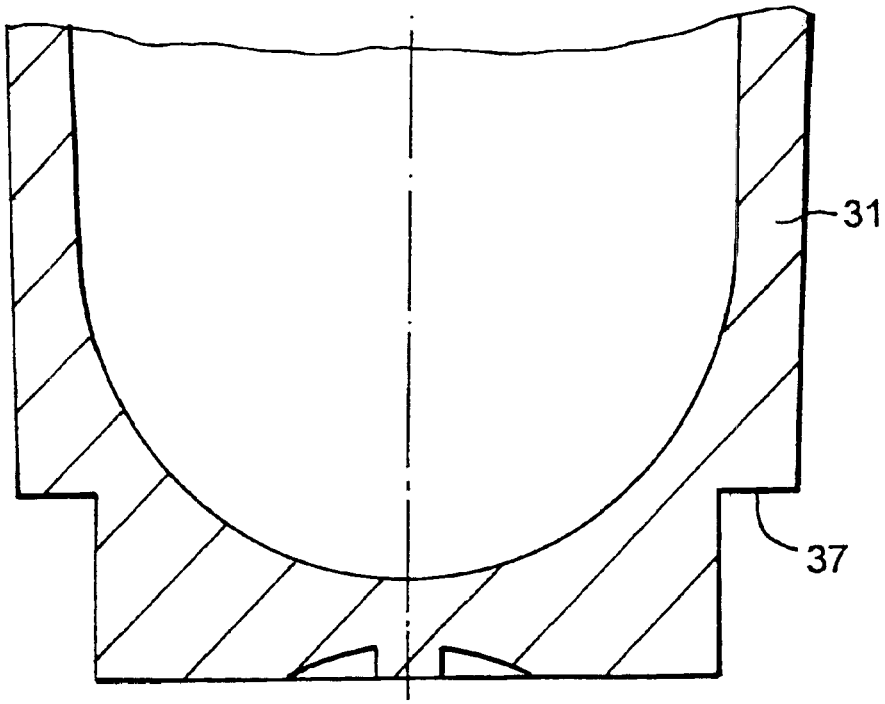
FIG. 3 illustrates the bottom of a tube portion showing a reduced diameter end region.
Figure 4:
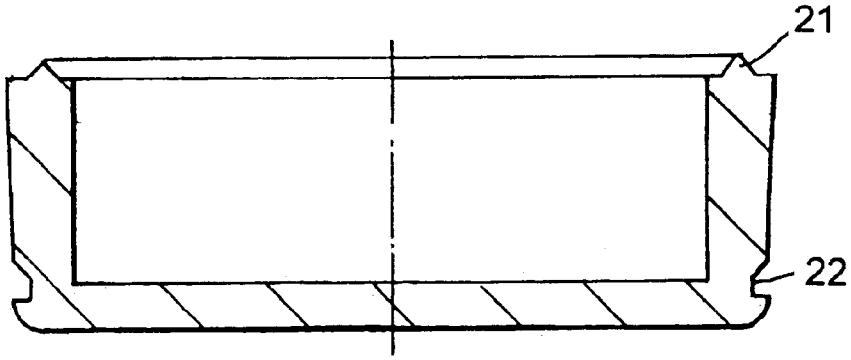
FIG. 4 illustrates a bottom end cap.
Figure 5A:
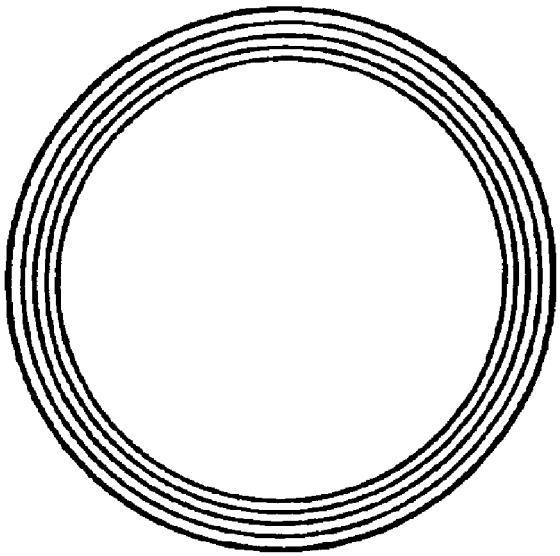
FIGS. 5 and 6 illustrate plan, cross-sectional and side elevational views respectively of the bottom end cap illustrated in FIG. 4.
Figure 5B:
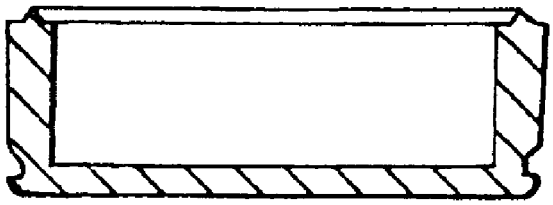
Figure 6:
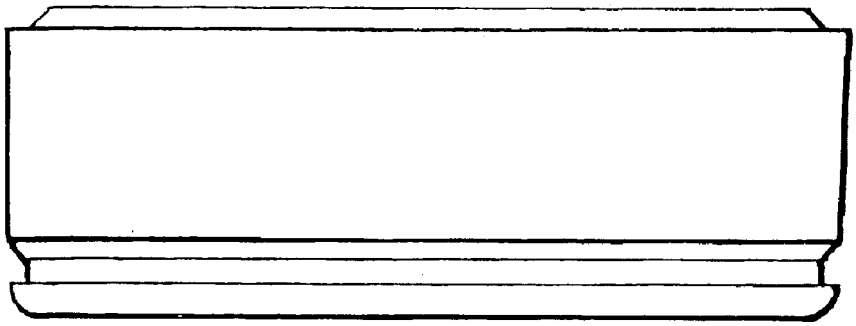
Figure 7:
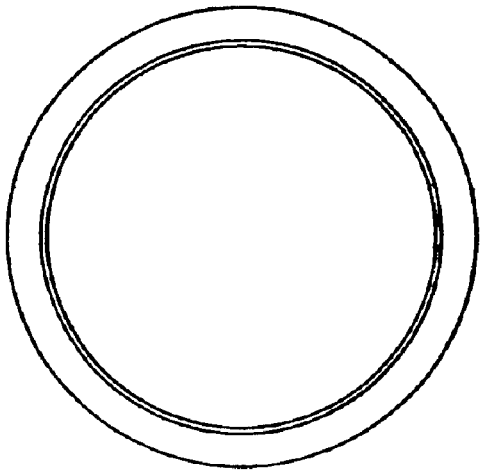
FIGS. 7 and 8 illustrate plan and cross-sectional views respectively of a bottom end cap according to a second embodiment.
Figure 8:
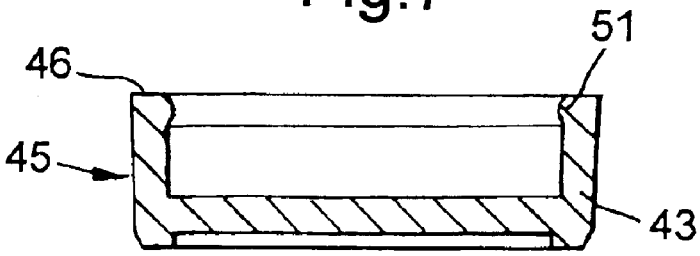
Figure 9:
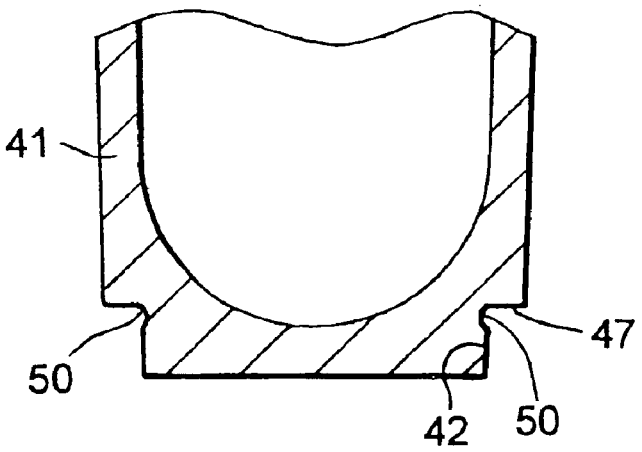
FIG. 9 illustrates a cross-sectional view of a tube portion according to the second embodiment.
Figure 10:
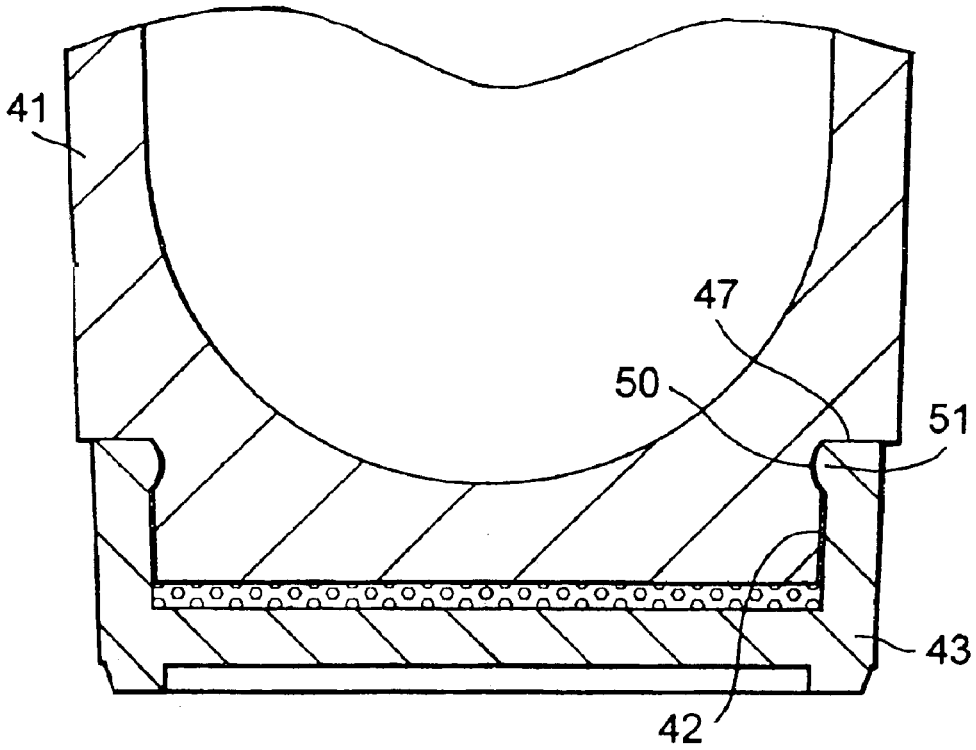
FIG. 10 shows an enlarged view of the bottom tip of a tube assembly according to the second embodiment.

Turning to FIGS. 3 and 4 in combination, these illustrate in FIG. 3 the bottom of a tube portion 31 having a shoulder 37 against which the sidewall of the end cap butts against during assembly. In this example there is a ridge of material 21 around the circumference of the end cap sidewall but no corresponding groove in the shoulder 37 in the bottom of the tube portion. Thus, prior to forming the fluid tight joint the tip of the ridge rests on shoulder 37.

Application of heat or ultrasound in this region causes the ridge to melt and the tube portion and the end cap are sealed together.

Figure 11:
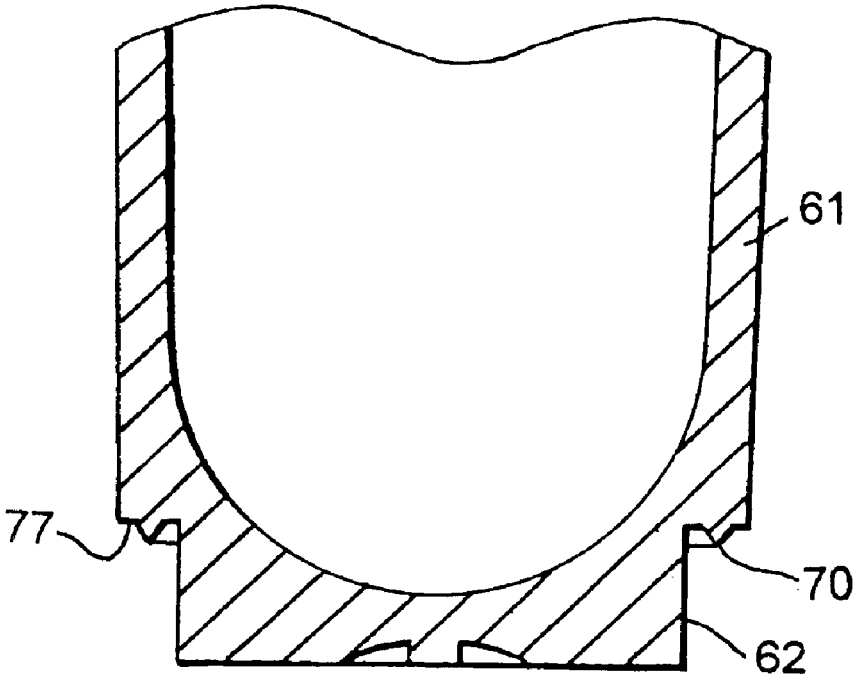
FIGS. 11 and 12 illustrate cross-sectional views of the bottom of a tube portion and the bottom end cap respectively according to a third embodiment of the present invention.
Figure 12:
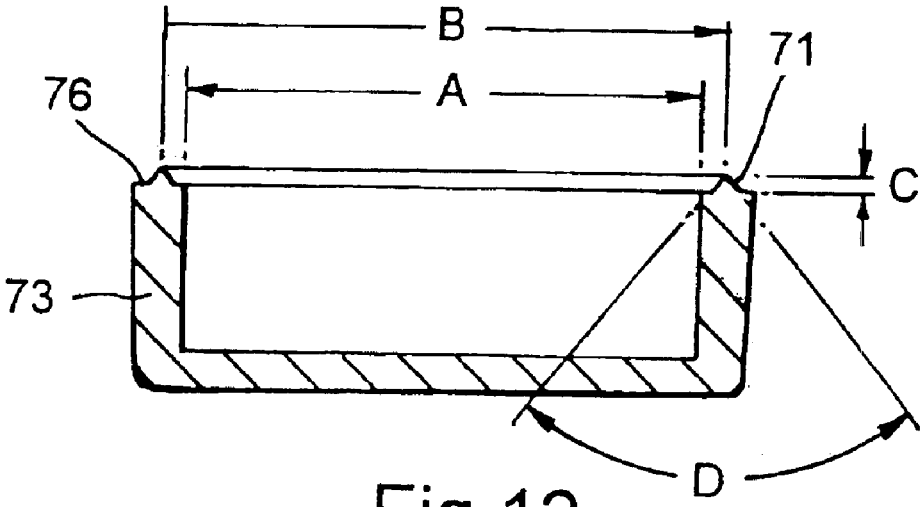

An extension and further modification of this sealing system is shown in FIGS. 11 and 12. FIG. 11 illustrates the bottom of a tube portion 61 similar to that illustrated in FIGS. 2 and 3. However, in this example the shoulder 77 around the bottom of the tube portion also incorporates a ridge of material 70. This ridge of material corresponds to a similar ridge 71 on the top edge of the sidewall of the bottom end cap 73. When the two components are offered up to each other the two ridges 70 and 71 contact each other and prevent the shoulder 77 on the tube bottom and the flat portion 76 on the bottom end cap sidewall contacting each other. Application of heat or ultrasound to the ridges when they are in this configuration causes both ridges to melt and the two parts to become fused together in a fluid tight fashion, Pressure is applied to the two components during the welding or fusing process such that the cap is forced onto the bottom of the tube portion in an attempt to make surfaces 76 and 77 meet. Material from the ridges 70 and 72 flows both outwards to the outside of the tube and inwards towards the central axis of the tube body.

Other constructional features of the tube shown in FIGS. 11 and 12 correspond to those shown in FIGS. 2, 3 and 4 and a corresponding numbering system has been used. The profile of the ridges in Figures described so far have been shown as substantially triangular. This is only one of a wide range of profiles which could be used. Essentially the ridge functions as a source of material which can be melted to form a joint between the tube portion and the bottom end cap. The materials specialist will determine the optimum size, shape, location and number of ridges and channels or material which will take part in or contribute to the fluid tight joint between tube portion and end cap. It will be appreciated that a heat activated adhesive could be used instead of or as well as melting or fusing material of the same composition as the tube portion of bottom end cap. In addition the materials specialist will determine the optimum location for any ridges, grooves, channels or the like.

By way of example only some dimensions are given for the type of cluster tubes illustrated in the figures. The total tube length is in the region of 47 mm, including the end cap and label, With reference to FIG. 12, dimension A is 5.10 mm, dimension B is 5.60 mm and dimension C i.e. height of ridge is 0.15 mm. The angle D is 80°. These dimensions will be varied to suit the application. The label is in the region of 0.21 mm thick.

So far these ridges have been shown in the shoulders which abut each other in the longitudinal axis of the tube. One example of a different arrangement is shown in FIGS. 7, 8, 9 and 10. In this embodiment a bottom end cap 43 is adapted to fit over the bottom end of a tube portion 41. A ridge or protrusion 51 is provided on the inner surface of the sidewall of the end cap. This protrusion fits into a corresponding groove or channel 50 in the sidewall of the tube portion 41 in a region where the diameter of the tube portion is smaller than the general outside diameter of the tube. This results in the cap being a snap fit onto the bottom end of the tube portion. The protrusion 51 acts as a bead of material which can form a seal around the tube portion. Application of heat or ultrasound energy to this sealing bead region causes the two components to fuse together.

In the examples described so far the label has been encapsulated in a label chamber formed by a combination of a cap and the end of a tube. This is not the only type of arrangement which is possible. For example, a label could be encapsulated into a label chamber which is an entity in its own right, separate from the body of the tube portion. This label chamber, with the label inside it, is then joined to the tube body by welding, fusing or adhesive or by some other method. For example, the fluid tight label chamber could engage with some feature on the tube body, such as being a snap fit into cavity on the tube body base. This arrangement achieves the same objective and has the same advantages as the embodiments described above.

It is not intended that the label chamber has, of necessity, to be attached to the base of the tube portion. It can be attached at any suitable point on the bottom or the side of the tube, providing this does not interfere with the operational use of the tube.

By way of an example of the flexibility of the present invention, a label chamber could also be formed by creating a double skinned tube. The label would then occupy the interstitial space between the two tubes and would be visible from and readable through the side of the tube. This arrangement requires that at least a portion of the outer tube component is transparent or substantially transparent.

Figure 13:
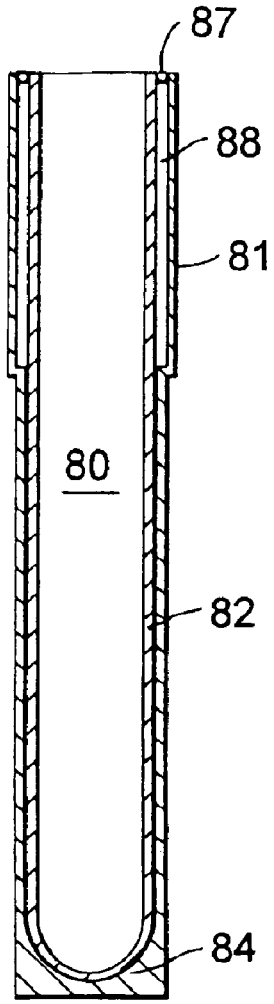
FIGS. 13 and 14 illustrate diagrammatic cross-sectional views of a fourth embodiment of the present invention.
Figure 14:
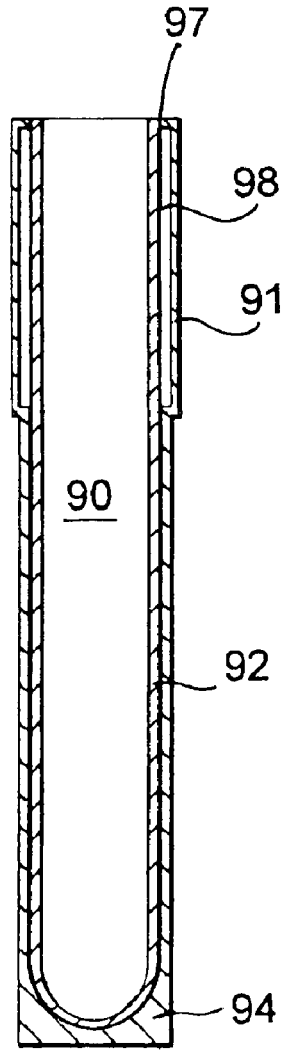

This further embodiment of the present invention is illustrated in FIGS. 13 and 14. These show diagrammatically tubes 80, 90 formed from an outer tube portion 81, 91 and an inner tube portion 82, 92 respectively. The base of the outer tube portions 84, 94 are substantially flat. The inner and outer tube portions nest one within the other and in the lower part are a snug fit. However, in the upper part of the tube there is a gap or discrete interstitial space 88, 98 between the inner and outer portions. This space is adapted to accommodate a label, not shown. The label carries similar information as described above. A fluid tight seal 87, 97 is formed around the top of perimeter of the tube between the two tube portions to complete the fluid tight label chamber shown as 88 and 98 in the figures.

Whilst FIGS. 13 and 14 show straight-sided tubes, any shape of tube is possible including the conventional cluster tube shape. Additionally, in these figures the outer tube portion is shown substantially surrounding the whole of the inner tube portion. This is not necessary and the outer tube portion could be limited to the region of the label chamber, or finish at some point intermediate the top and bottom of the tube.

The detail around the top of the tube and in any other joining regions will be determined by the materials specialist. Spacer, joining pieces and the like can be used. It is envisaged that ultrasonic welding will be used to provide a robust fluid tight weld in production.

With regards to the transparency of the label chamber there is a requirement that the label information can be read optically. The region of the label chamber directly over label code information must be sufficiently transparent or translucent that the code can be determined. The remainder of the label chamber need not be transparent and it is envisaged that a form of lens area will be provided in front of the label code area. This lens area could be convex or otherwise shaped to give some magnification if required.

The term "bar code" in the context of this invention has a very broad meaning. It refers to any arrangements of symbols, known or yet to be discovered, which carry an optically readable code. It includes, but is in no way limited to, a series of bars, dots, spaces, pits, shaded areas, coloured areas, or the like. The code may also include alphanumerics. It may also include some registry, registration feature or orientation mark to assist in reading the code in the correct orientation. It is anticipated that the code will be machine readable to assist in the rapid robotic handling of the tubes.

What is claimed is:

1. A sample tube assembly comprising:

a tube portion having a bottom;

an end cap mounted to the bottom of the tube portion and providing substantially fluid-tight seal therewith;

a label chamber defined by a substantially fluid-tight space between the bottom of the tube portion and the end cap; and a label having an optically readable code and encapsulated inside the label chamber, wherein the end cap includes a region over the label that is sufficiently transparent for the optically readable code to be read through the end cap region from below the bottom of the tube portion.

2. The sample tube assembly of claim 1 wherein the end cap comprises a base and an upstanding sidewall extending substantially around the perimeter of the end cap, the sidewall extending from the base to the bottom of the tube portion.

3. The sample tube assembly of claim 2 wherein the sidewall of the end cap incorporates a first ridge extending substantially around the circumference of the sidewall.

4. The sample tube assembly of claim 3 wherein the tube portion comprises a shoulder formed around the bottom of the tube portion, said shoulder including a second ridge extending substantially around the circumference of the tube portion.

5. The sample tube assembly of claim 4 wherein the first ridge on the end cap and the second ridge on the tube portion contact each other when the end cap is placed onto the bottom of the tube portion.

6. The sample tube assembly of claim 5 wherein the contacting first and second ridges are heated and compressed together to form a fluid-tight seal between the tube portion and the end cap.

7. The sample tube assembly of claim 1 wherein the end cap includes a ridge and the tube portion includes a groove adapted to co-operatively engage the ridge.

8. The sample tube assembly claim 1 wherein the end cap includes a groove and the tube portion includes a ridge adapted to co-operatively engage with the groove.

9. The sample tube assembly claim 7 wherein the ridge of the end cap snap fits with the groove of the tube portion.

10. The sample tube assembly of claim 8 wherein the groove of the end cap snap fits with the ridge of the tube portion.

11. The sample tube assembly of claim 1 wherein the label is a laser etched label.

12. The sample tube assembly of claim 1 wherein the label is formed from paper.

13. The sample tube assembly of claim 1 wherein the label is formed from a plastics material.

14. The sample tube assembly of claim 1 wherein the optically readable code includes a bar code.

15. The sample tube assembly of claim 1 wherein the optically readable code includes a binary code.

16. The sample tube assembly of claim 1 wherein the optically readable code includes an alphanumeric code and at least one of a bar code and a binary code.

17. The sample tube assembly of claim 1 wherein the end cap is fused to the tube portion using ultrasonic welding.

18. The sample tube assembly of claim 1 wherein the optically readable code includes at least one of optically readable shapes and optically readable characters.

19. The sample tube assembly of claim 1 wherein the optically readable code is printed on the label before the label is encapsulated inside the label chamber.

20. The sample tube assembly of claim 7 wherein the groove is an endless groove extending substantially about the circumference of the tube portion.

21. The sample tube assembly of claim 7 wherein the groove is an endless groove extending substantially about the circumference of the end cap.

22. The sample tube assembly of claim 1 wherein the end cap has a snap fit with the bottom of the tube portion.

23. The sample tube assembly of claim 1 wherein the bottom of the tube portion includes a reduced diameter end region that snap fits with the end cap.

24. The sample tube assembly of claim 1 wherein the label chamber overlies the bottom of the tube portion.

25. The sample tube assembly of claim 1 wherein the end cap is hermetically sealed with the bottom of the tube portion.

26. The sample tube assembly of claim 1 wherein the tube portion is made from polypropylene.

27. An apparatus for holding a sample, comprising:

a label including an optically readable code; and a body including a cavity, an opening through which the sample can be inserted into said cavity, and a substantially liquid-tight chamber encapsulating said label, at least a region of said body being sufficiently transparent to facilitate optically reading said optically readable code through said transparent region.

28. The apparatus of claim 27 wherein said body includes a top end and a bottom end opposite said top end, said opening in said body is positioned at said top end, and said chamber is positioned adjacent to said bottom end.

29. The apparatus of claim 28 wherein said chamber includes a base located proximate to said bottom end of said body and a sidewall extending substantially around a periphery of said chamber.

30. The apparatus of claim 29 wherein said transparent region of said body comprises a portion of said base.

31. The apparatus of claim 28 wherein said label is oriented within said chamber such that said optically readable code is readable from a position below said bottom end.

32. The sample tube assembly of claim 27 wherein said chamber is hermetically sealed.

33. The sample tube assembly of claim 27 wherein said body is made from polypropylene.

34. An apparatus for holding a sample, comprising:

a label having an optically readable code;

a tube portion including a top end, a bottom end, a cavity, and an opening defined proximate said top end for inserting the sample into said cavity; and an end cap having a substantially liquid-tight seal with said bottom end of said tube portion to define a chamber between said end cap and said tube portion, said label encapsulated inside said chamber and oriented such that said optically readable code faces away from said first cavity, and said end cap having a region sufficiently transparent to read said optically readable identifier from below said tube portion.

35. The apparatus of claim 34 wherein said end cap includes a base and a sidewall encircling a perimeter of said base, said sidewall extending from said base to said bottom end of said tube portion to thereby surround said liquid-tight chamber.

36. The apparatus of claim 35 wherein said sidewall is fused with said base.

37. The apparatus of claim 34 wherein said end cap and said tube portion are configured to provide a snap fit between said end cap and said tube portion.

38. The apparatus of claim 34 wherein said end cap and said tube portion are configured to provide an interference fit between said end cap and said tube portion.

* * * * *

UNITED STATES PATENT AND TRADEMARK OFFICE

CERTIFICATE OF CORRECTION

PATENT NO. : 6,884,397 B2
DATED : April 26, 2005
INVENTOR(S) : Paul Francis Day

It is certified that error appears in the above-identified patent and that said Letters Patent is hereby corrected as shown below:

Title page,
Item [57], ABSTRACT,
Line 5, change the ";" after "comprises" to -- : --.

Column 1,
Line 25, change "comers" to -- corners --.

Column 6,
Line 32, change the "," after the word "matter" to a -- . --.

Column 9,
Line 5, after the word "providing," insert the word -- a --.
Lines 41 and 43, after the word "assembly," insert the word -- of --.

Signed and Sealed this

Twenty-third Day of August, 2005

JON W. DUDAS
*Director of the United States Patent and Trademark Office*